US006059532A

United States Patent [19]

Chen et al.

[11] Patent Number: 6,059,532

[45] Date of Patent: May 9, 2000

[54] AXIAL FLOW TURBO-MACHINE FAN BLADE HAVING SHIFTED TIP CENTER OF GRAVITY AXIS

[75] Inventors: Robert P. Chen, Torrance; Terry L. Morris, Garden Grove; Ramesh C. Doshi, La Pama, all of Calif.

[73] Assignee: AlliedSignal Inc., Morristown, N.J.

[21] Appl. No.: 09/082,412

[22] Filed: May 20, 1998

Related U.S. Application Data

[60] Provisional application No. 60/062,811, Oct. 24, 1997.

[51] Int. Cl.[7] ..... B63H 1/28

[52] U.S. Cl. ..... 416/223 A; 416/228; 416/235; 416/237; 416/238; 416/242; 416/243

[58] Field of Search ..... 416/223 R, 223 A, 416/228, 242, 243, 235, 237, 238

[56] References Cited

U.S. PATENT DOCUMENTS

| | | | |
|---|---|---|---|
| D. 141,589 | 6/1945 | Logsdon . | |
| 2,131,217 | 9/1938 | Bumwell . | |
| 3,822,105 | 7/1974 | Jepson | 416/223 |
| 4,028,003 | 6/1977 | Krauss | 416/141 |
| 4,130,377 | 12/1978 | Blackwell, Jr. | 416/132 R |
| 4,202,655 | 5/1980 | Maloof . | |
| 4,291,235 | 9/1981 | Bergey, Jr. et al. | 290/55 |
| 4,413,796 | 11/1983 | Bousquet | 244/35 R |
| 4,421,394 | 12/1983 | Schon et al. . | |
| 4,477,228 | 10/1984 | Duffy et al. . | |
| 4,869,644 | 9/1989 | Takigawa | 416/235 |
| 4,883,240 | 11/1989 | Admason et al. . | |
| 5,118,257 | 6/1992 | Blakely et al. . | |
| 5,158,434 | 10/1992 | Weetman . | |
| 5,161,953 | 11/1992 | Burtis . | |
| 5,217,349 | 6/1993 | Succi . | |

*Primary Examiner*—Edward K. Look
*Assistant Examiner*—Ninh Nguyen
*Attorney, Agent, or Firm*—William J. Zak, Jr., Esq.

[57] ABSTRACT

A high aspect ratio, low solidity fan blade of an axial flow air cycle machine has a local tip center of gravity axis that has been shifted ahead of an elastic axis. The center of gravity axis can be shifted by clipping the tip of the blade at the trailing edge, by undercutting a rear portion of the pressure surface, or by sweeping forward leading and trailing edges of the blade by about five degrees (without clipping or undercutting the blade).

19 Claims, 3 Drawing Sheets

AXIAL FLOW TURBO-MACHINE FAN BLADE HAVING SHIFTED TIP CENTER OF GRAVITY AXIS

This application claims the benefit of Chen et al. provisional application no. 60/062,811 filed on Oct. 24, 1997.

BACKGROUND OF THE INVENTION

The present invention relates in general to turbo-machinery. More particularly, the present invention relates to reducing fatigue failure of fan blades for axial flow turbo-machines such as air cycle machines.

Environmental control systems including air cycle machines have long been used in military and commercial aircraft to supply air at flow rates desirable for heating, cooling and pressurizing aircraft cabins. Air cycle environmental control systems are light in weight and have low maintenance requirements. Additionally, air cycle environmental control systems use clean working fluid—compressed air—instead of refrigerants that are harmful to the environment.

Greater comfort demands of customers and higher heat loads (due to a greater on-board usage of personal electronics and other heat-generating devices) have significantly increased the demand for higher cooling capacities of the air cycle machines. To satisfy this demand, efforts have been directed towards increasing fan flow rates of axial flow air cycle machines. Increasing the length to width ratio (i.e. increasing the aspect ratio) of the fan blades and increasing the spacing between the fan blades (i.e., lowering the solidity) have been proposed to increase flow rates without increasing fan diameter (for those air cycle machines having fans) and without decreasing air cycle machine performance.

However, problems with fatigue failure have been reported for high aspect ratio, low solidity blades. Constant cycle reversals of bending and torsion coupled with transonic/supersonic flutter have been determined to cause cracks and subsequent breaks in the blades. A broken blade can create an imbalance in the air cycle machine. The imbalance, in turn, can damage the journal and thrust bearings and cause them to seize. If the journal and/or thrust bearings seize, the air cycle machine is either rebuilt or replaced.

Fatigue life of high aspect ratio, low solidity fan blades could be increased by increasing blade thickness and using larger fillet radii. However, this approach adds to the size and weight of the air cycle machine and, therefore, is undesirable. Moreover, this approach involves redesign and fabrication of new fan blades, but does not address potential fatigue failure problems facing high aspect ratio, low solidity fan blades of air cycle machines that have already been built and sold to customers.

SUMMARY OF THE INVENTION

The present invention can be regarded as a high aspect ratio, low solidity blade having a center of gravity axis that is shifted ahead of the blade's elastic axis. Such a shift reduces coupling of torsion from bending. Consequently, fatigue life of the blade is increased.

BRIEF DESCRIPTION OF THE DRAWING FIGURES

DETAILED DESCRIPTION OF THE INVENTION

Figure 1:
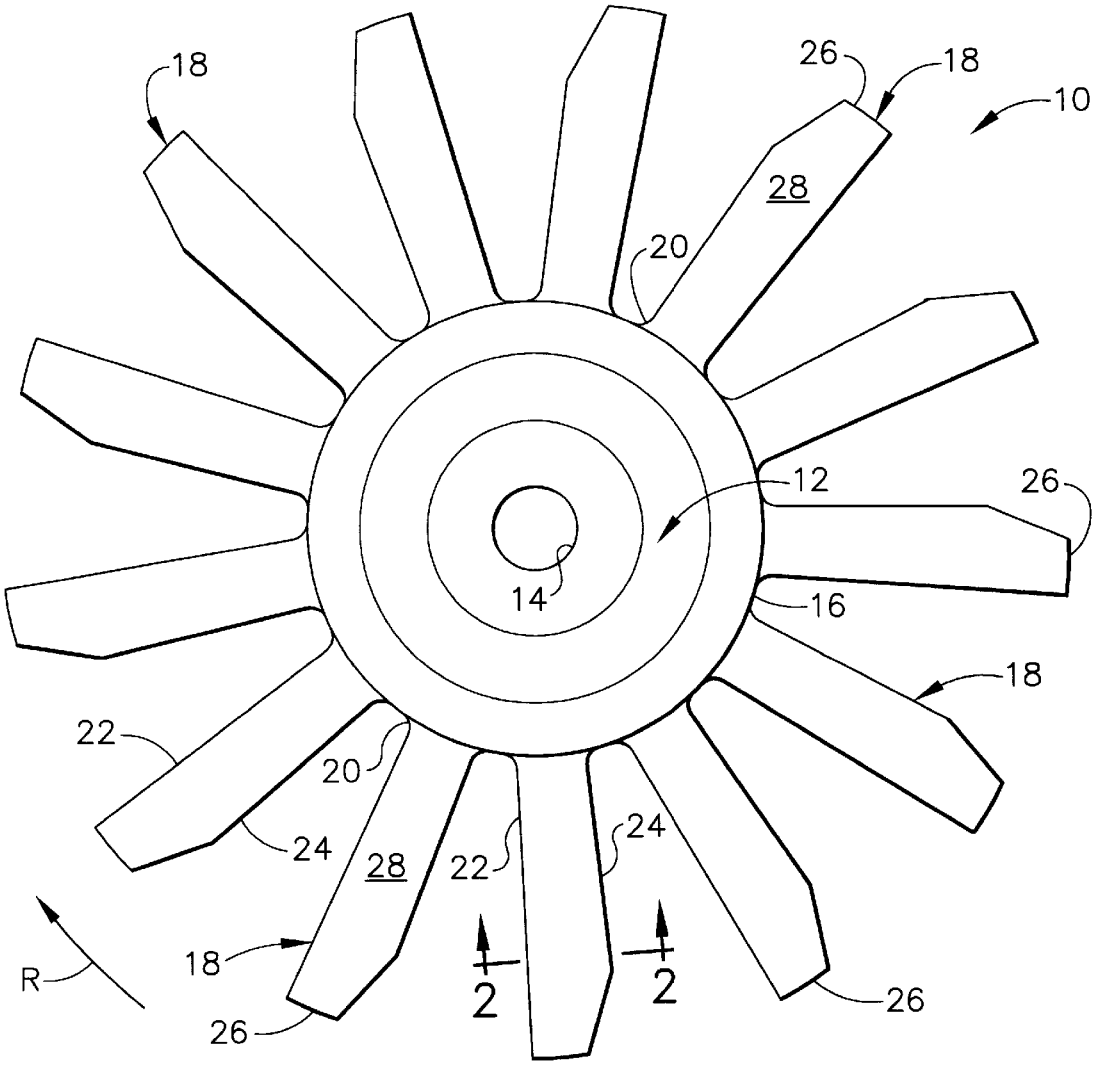
FIG. 1 is an illustration of a turbo-machine fan having multiple blades, each of which is damped in accordance with the present invention.

FIG. 1 shows an exemplary fan 10 of an air cycle machine. The fan 10 includes a hub portion 12 defining a central hole 14, through which a tie bolt (not shown) may pass in order to secure the fan to other components (also not shown) of the air cycle machine. The hub portion 12 defines an outer surface 16. Extending radially outward from the outer surface 16 are a plurality of fan blades 18. The blades 18 may be integral with the hub portion 12. Each blade 18 includes a root radius portion 20 at which the blade 18 blends into the hub portion 12, a leading edge 22, a trailing edge 24, a radially outer tip portion 26, and a mid-span portion 28 intermediate the root portion 20 and the tip portion 26. Generally the hub 12 and blades 18 are formed of metal. Any structural material having adequate strength (e.g., titanium, aluminum, steel, composite) may be used for the fan 10.

When the fan 10 is rotated in the direction of the arrow R, the blades 18 form a pressure region in front of the fan 10 and a suction region behind the fan 10. Air flows from the suction region to the pressure region. Lowering the solidity of the blades 18 increases the flow rate of the air. The blades 18 have a solidity of about forty percent at the tip portion 26 and a solidity of about one hundred twenty percent at the root portion 20. The blades 18 also have high aspect ratios. Both the solidity and the aspect ratio affect whether the blade 18 behaves like a beam or a plate. A blade 18 having low solidity and a high aspect ratio will behave as a beam instead of a plate when subjected to aerodynamic forces. A blade 18 behaving as a beam will have at least first and second modes of bending, followed by a first mode of torsion.

Figure 2:
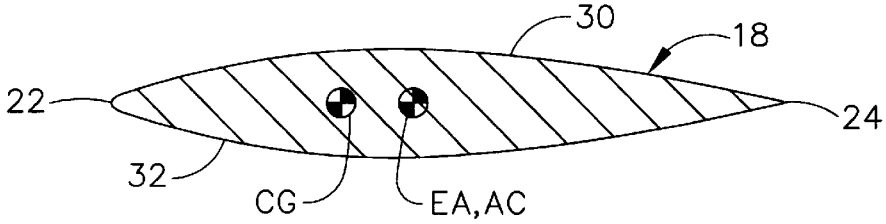
FIG. 2 is a cross-sectional view of one of the fan blades shown in FIG. 1, the cross-section being taken at lines 2—2 of FIG. 1.
Figure 3:
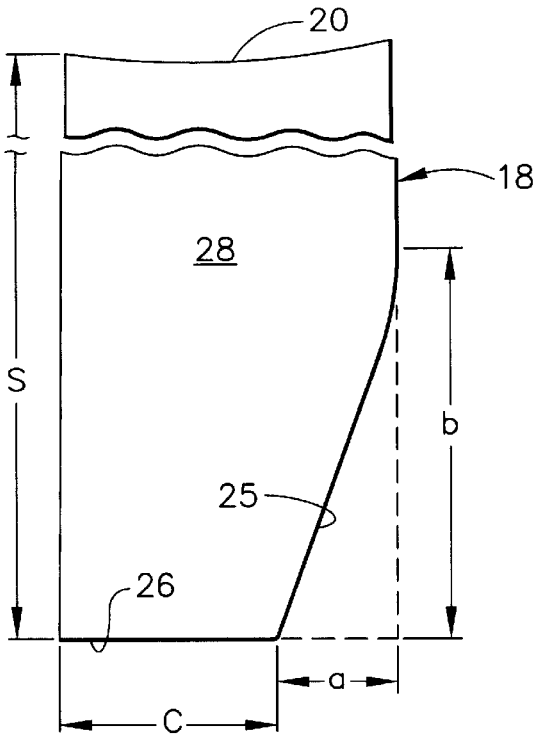
FIG. 3 is an illustration of one of the fan blades shown in FIG. 1.

Additional reference is now made to FIG. 2, which shows the cross-section of one of the blades 18. Reference is also made to FIG. 3. The blade 18 has the shape of a full-span double circular arc airfoil, which is most common for supersonic flow. A suction surface 30 and a pressure surface 32 meet at the leading and trailing edges 22 and 24. The blade 18 has an elastic axis EA and an aerodynamic center AC that are co-aligned at fifty percent of local chord length or maximum thickness locations of the blade 18 airfoil sections, which is typical for supersonic airfoils. Unlike conventional full-span double circular arc airfoils, which have a local tip center of gravity axis co-aligned with the elastic axis, the blade 18 according to the present invention has a local tip center of gravity axis CG that is shifted ahead of the elastic axis EA in a direction towards the leading edge 22. The center of gravity axis CG is shifted ahead of the elastic axis EA by about two percent to five percent of tip chord length C of the blade 18.

The shift reduces the coupling of the first bending mode from the first torsion mode. Depending upon span length S of the blade 18, the shift could also reduce the coupling of the second bending mode from the first torsion mode. Reducing the coupling of the blade torsion from blade bending increases aerodynamic damping and reduces the chance of fatigue failure.

The following paragraphs provide various examples of how a blade 18, 118, 218 or 318 can be modified to shift its center of gravity axis CG ahead of its elastic axis EA without shifting the elastic axis EA. FIGS. 1 and 3 show a blade 18 that is modified by clipping the trailing edge 24 at the tip portion 26. The trailing edge 24 is clipped such that the tip chord length C and the near-constant span chord length S are reduced by between 25% and 45%. For example, the tip chord length C and the span chord length S could both be reduced by about a/C=b/S=30%. However, the tip chord and the span chord do not have to be clipped by the same percentage. For instance, the tip chord length C could be reduced by a/C=30% and the span chord length S could be reduced by b/S=15%. Or, the tip chord length C could be reduced by a/C=35% and the span chord length S could be reduced by b/S=40%.

The tip portion 26 could be clipped by a straight cut or a curved cut. Portions at the rear of both the suction surface 30 and the pressure surface 32 are removed. Sharp edges at the clipped edge 25 are broken. Thickness of the clipped edge 25 could be reduced to the thickness of the trailing edge 24 of the unclipped portion of the blade 18, or the clipped edge 25 could be left blunt (and, therefore, thicker than the trailing edge 24 of the unclipped portion of the blade 18). However, thinning down the clipped edge 25 will restore some of the aerodynamic performance of the blade 18.

Figure 4:
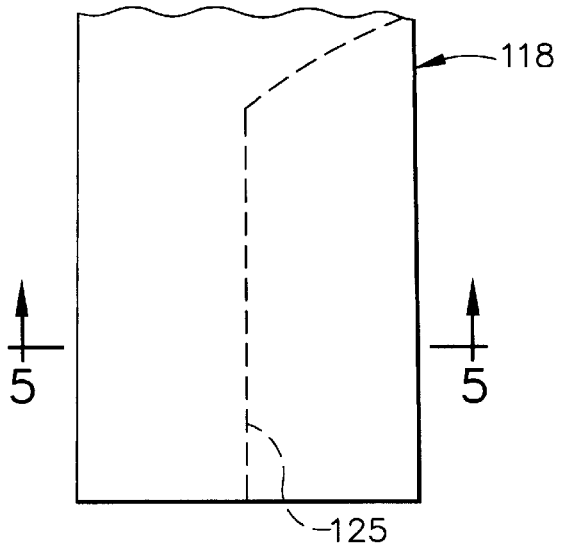
FIG. 4 is an illustration of an alternative embodiment of a fan blade according to the present invention.
Figure 5:
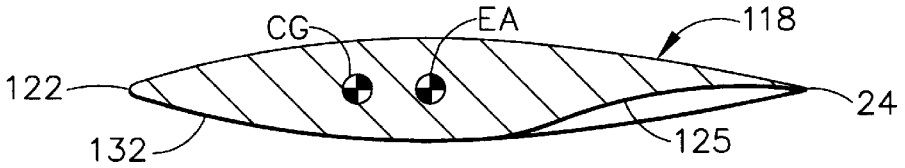
FIG. 5 is a cross-sectional view of the fan blade shown in FIG. 4, the cross-section being taken at lines 5—5 of FIG. 4.

FIGS. 4 and 5 show a blade 118 that is modified by forming a reverse curve 125 at a rear portion of the pressure surface to form a transonic low Reynolds number airfoil. The Reynolds number will be in the range of $1\times10^5$ to $2\times10^5$. The reverse curve 125 can be formed by undercutting a rear portion of the pressure surface 132. Between forty percent and sixty percent of the pressure surface 132 is removed. Blending the reverse curve 125 into the trailing edge 124 will reduce the interference with the airflow. Reducing the Reynolds number of the blade will also improve transonic flow over the blade 118 and, therefore, will improve performance of the blade 118. The shape of the reverse curve 125 can be obtained from tables for airfoils of fixed wing aircraft designed for operation at high altitudes.

Figure 6:
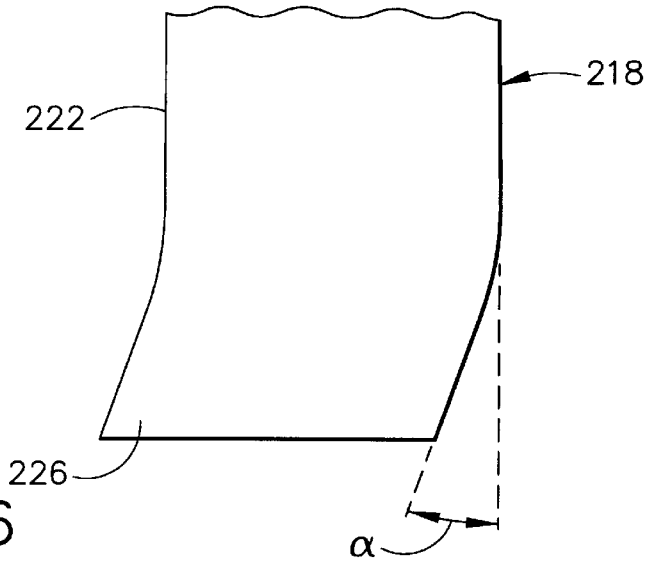
FIG. 6 is an illustration of another embodiment of a fan blade according to the present invention.

FIG. 6 shows that the blade 218 is modified without removing a portion of the pressure surface. Instead, the tip portion 226 of the blade 218 at the leading edge 222 is swept forward. The angle a of the sweep forward portion for a blade 218 having the shape of a full-span double arc airfoil is between 5 degrees and 10 degrees. The sweep-forward portion is not bent out of the plane of the blade 218.

Figure 7:
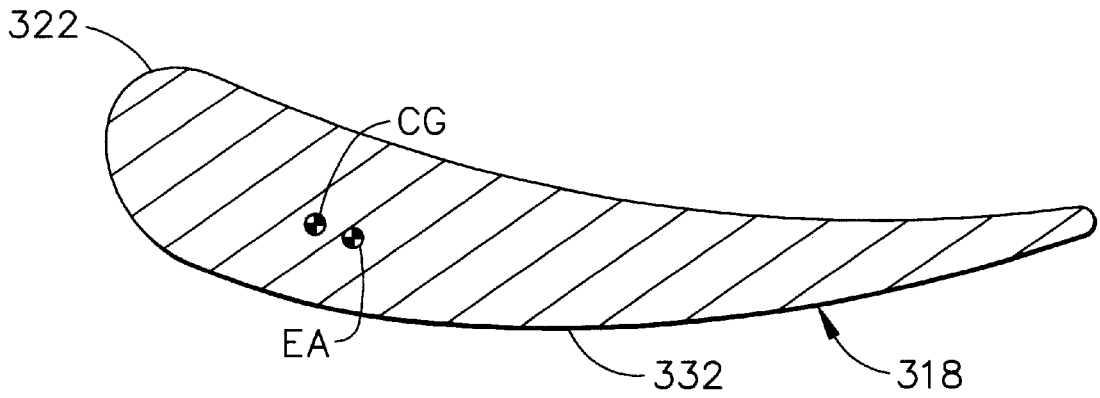
FIG. 7 is a cross-sectional view of yet another embodiment of a fan blade according to the present invention.

FIG. 7 shows a blade 318 having a cambered shape, which is commonly used for subsonic flow. The elastic axis EA and the aerodynamic center AC are typically fixed at less than fifty percent and twenty five percent of local chord length respectively for subsonic airfoils. Unlike conventional airfoils, which have a center of gravity axis that is behind the elastic axis EA, the blade 318 according to the present invention is modified to shift the center of gravity axis CG ahead of the elastic axis EA in a direction towards the leading edge 322.

Since the center of gravity axis CG was originally behind the elastic axis EA, a larger shift is required (relative to the shift required for the blade 18 having the shape of the full-span double arc airfoil) to move the center of gravity axis CG ahead of the elastic axis EA by about two percent to five percent. This implies that the center of gravity axis CG is shifted by removing a larger portion of the pressure surface 332 or by increasing the sweep-forward angle a of the tip portion (relative to the blades 18, 118 and 218 having the shape of the full-span double arc airfoil).

Blades of a new fan can be designed and fabricated with the center of gravity axes shifted ahead of the elastic axes. In the alternative, blades of an existing fan can be modified to shift forward their center of gravity axes.

Figure 8:
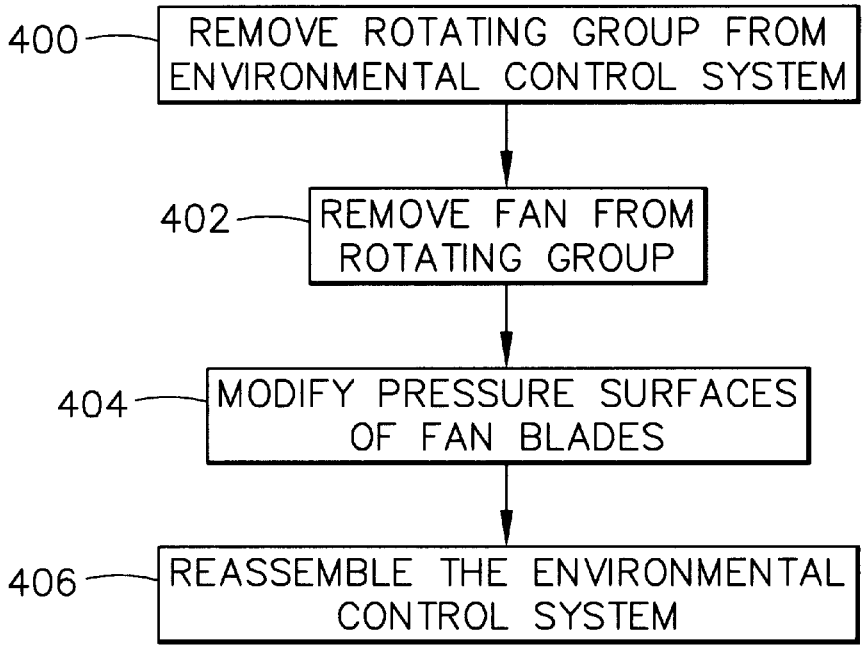
FIG. 8 is a flowchart of a method of modifying fan blades of an air cycle machine.

Referring to FIG. 8, the fan of an axial flow air cycle machine can be modified as follows. A rotating group including the fan is removed from a housing of the air cycle machine of an environmental control system (block 400). The fan is disassembled from the rotating group (block 402), and the fan is modified by clipping the tips of the blades or undercutting rear portions of the pressure surfaces of the blades (block 404). After the fan has been modified, the environmental control system is reassembled (block 406).

Thus disclosed is a robust fan design in which the chances of high-cycle fatigue failures caused by elastic instability (flutter) and excessive inlet flow distortion (forced response) are reduced. Consequently, the blades are not as vulnerable to a source of excitation having a frequency close to the frequency of the critical modes. Also reduced is the chance of fatigue failure that might arise from a super-resonant region of flow fields which affect the stability of the elastic bending-torsion branches of the first and second bending modes, and a possible shock/boundary layer interaction due to relative Mach number varying from subsonic at the hub to supersonic at the tip, with a large transonic region in-between.

The invention allows existing fan blades to be modified to reduce the chances of failure arising from high-cycle fatigue failure. Thus, customers using existing air cycle machines do not have to procure new fans. Moreover, undercutting the pressure surfaces of the blades to closely match the low Reynolds number transonic/supersonic flow will enhance performance of the air cycle machine.

Although specific embodiments of the invention have been described and illustrated above, the invention is not limited to the specific forms or arrangements of parts so described and illustrated. For example, the present invention is not limited to fans of axial flow air cycle machines, but may be applied to other rotating components (e.g., compressor blades, turbine blades) of different types of turbomachines. The invention could even be applied to blades that behave like plates having a bending/torsion-coupled-flutter problem.

As for modifications to the blade, the distance that the center of gravity axis is shifted past the elastic axis will depend upon factors such as the size of the blade (which affects bending and torsion modes), the shape of the blade, and how much of the pressure surface can be cut away without significantly impacting aerodynamic lift. Design considerations such as the stagger angle of the blades, solidity of the blades, aspect ratio of the blades, type of airfoil shape used by the blades will be dictated by the operating requirements of the turbo-machine.

Thus, the invention is not limited to the specific embodiments described and illustrated above. Rather, the invention is construed according to the claims that follow.

We claim:

1. A blade of a rotating component of an axial flow turbo-machine, the blade comprising:

a root portion;

a tip portion; and a mid-span portion intermediate to the root portion and the tip portion;

the blade having a high aspect ratio and low solidity;

the blade further having a leading edge and a trailing edge, a local tip center-of-gravity axis between the leading and trailing edges, and an elastic axis between the leading and trailing edges, the tip portion being swept forward by an angle between 5 degrees and 10 degrees to shift the local tip center of gravity axis between the elastic axis and the leading edge.

2. The blade of claim 1, wherein the center of gravity axis is shifted ahead of the elastic axis by about two percent to five percent of tip chord length of the blade.

3. A rotating component of a turbo-machine, the component comprising:

a central hub; and a plurality of blades extending radially outward from the hub;

at least one of the blades having a tip portion, a root portion, a pressure surface, a suction surface, a leading edge and a trailing edge, and a solidity of about forty percent at the tip portion and about one hundred twenty percent at the root portion; the blade further having a local tip center-of-gravity axis and an elastic axis, a rear portion of the pressure surface having been removed to shift the center of gravity axis between the leading edge and the elastic axis.

4. The component of claim 3, wherein the component is a fan of an axial flow air cycle machine.

5. The component of claim 3, wherein the tip portion of at least one blade is clipped at the trailing edge such that tip chord length and the constant chord span length are each reduced by between 25% and 45%.

6. The component of claim 5, wherein the tip chord length and the constant chord span length are each reduced by about 30%.

7. The component of claim 3, wherein between forty percent and sixty percent of a rear portion of the pressure surface of at least one blade is undercut.

8. The component of claim 7, wherein the pressure surface is undercut such that the blade has a shape of a low Reynolds number transonic airfoil.

9. The component of claim 3, wherein the center of gravity axis is shifted ahead of the elastic axis by about two percent to five percent of tip chord length of at least one blade.

10. A method of modifying a fan of an air cycle machine, the fan including a hub and plurality of blades extending radially outward from the hub, each blade having a high aspect ratio, a tip chord, a pressure surface, a center of gravity axis and an elastic axis, the method comprising the step of:

modifying a rear portion of the pressure surface of each blade to shift the center of gravity axis ahead of the elastic axis by about two percent to five percent of tip chord length.

11. The method of claim 10, each blade having a tip portion and a trailing edge, wherein each blade is modified by clipping the tip portion at the trailing edge.

12. The method of claim 10, each blade having a trailing edge, wherein each blade is modified by undercutting a rear portion of the pressure surface.

13. A fan of an axial flow air cycle machine, the fan comprising:

a central hub; and a plurality of blades extending radially outward from the hub;

at least one of the blades having a tip portion, a pressure surface, a suction surface, a leading edge and a trailing edge; the blade further having a local tip center-of-gravity axis and an elastic axis, a rear portion of the pressure surface having been removed to shift the center of gravity axis between the leading edge and the elastic axis.

14. The fan of claim 13, wherein the blades have a solidity of about forty percent at the tip portion and about one hundred twenty percent at a root portion.

15. The fan of claim 13, wherein the tip portion of at least one blade is clipped at the trailing edge such that tip chord length and constant chord span length are each reduced by between 25% and 45%.

16. The fan of claim 15, wherein the tip chord length and the constant chord span length are each reduced by about 30%.

17. The fan of claim 13, wherein between forty percent and sixty percent of a rear portion of the pressure surface of at least one blade is undercut.

18. The fan of claim 17, wherein the pressure surface is undercut such that the blade has a shape of a low Reynolds number transonic airfoil.

19. The fan of claim 13, wherein the center of gravity axis is shifted ahead of the elastic axis by about two percent to five percent of tip chord length of at least one blade.

* * * * *